US006626332B2

(12) United States Patent
Ehrensperger et al.

(10) Patent No.: US 6,626,332 B2
(45) Date of Patent: Sep. 30, 2003

(54) METHOD AND DEVICE FOR THE CONTROLLED DISPENSING OF CLEANSING FOAM

(75) Inventors: Markus Ehrensperger, Hettlingen (CH); Hans-Jörg Studer, Hittnau (CH)

(73) Assignee: HTS International Trading AG, Baar (CH)

( * ) Notice: Subject to any disclaimer, the term of this patent is extended or adjusted under 35 U.S.C. 154(b) by 0 days.

(21) Appl. No.: 10/181,532

(22) PCT Filed: Jan. 16, 2001

(86) PCT No.: PCT/CH01/00028

§ 371 (c)(1),
(2), (4) Date: Jul. 18, 2002

(87) PCT Pub. No.: WO01/53002

PCT Pub. Date: Jul. 26, 2001

(65) Prior Publication Data

US 2003/0000967 A1 Jan. 2, 2003

(30) Foreign Application Priority Data

Jan. 19, 2000 (EP) ..... 00810042

(51) Int. Cl.[7] ..... B05B 11/00

(52) U.S. Cl. ..... 222/190; 222/1; 222/51; 222/88; 222/108; 222/571; 239/119

(58) Field of Search ..... 222/51, 95, 105, 222/108, 109, 110, 318, 190, 82, 88, 83, 83.5, 207, 213, 181.3, 375, 424, 383.1, 571, 1; 239/109, 119

(56) References Cited

U.S. PATENT DOCUMENTS

| | | | | | |
|---|---|---|---|---|---|
| 1,945,725 | A | * | 2/1934 | Bonney | 222/51 X |
| 4,349,131 | A | * | 9/1982 | Arabian | 222/190 X |
| 4,477,000 | A | * | 10/1984 | Arabian | 222/190 X |
| 5,348,189 | A | * | 9/1994 | Cater | 222/1 |
| 5,544,788 | A | * | 8/1996 | Meyer | 222/190 X |
| 5,779,104 | A | * | 7/1998 | Reidel | 222/190 |
| 5,862,954 | A | * | 1/1999 | Ehrensperger et al. | 222/190 |
| 5,984,146 | A | * | 11/1999 | Kaufman | 222/190 |

* cited by examiner

*Primary Examiner*—Ehud Gartenberg
*Assistant Examiner*—Eric Keasel
(74) *Attorney, Agent, or Firm*—Schweitzer Cornman Gross & Bondell LLP

(57) ABSTRACT

The invention relates to a dispenser for foamable liquids which has been improved with regard to the aspects of hygiene and reliability. According to the method, in addition to the pneumatic and hydraulic parts of the dispenser having a configuration which is to a great extent isolated from the external atmosphere, said dispenser has an air chamber (82) which subjects a nozzle/expansion body (74) first to an excess pressure and then to a negative pressure during the return stroke ($H_B$) of an air piston (42) via a lateral bore (89). As a result, the outlet (80) is first cleared and any remaining foam in the nozzle/expansion body (74) is subsequently removed by suction and coagulated into soap solution. During the next working stroke, this minimal quantity of soap-solution is foamed again and expelled.

12 Claims, 7 Drawing Sheets

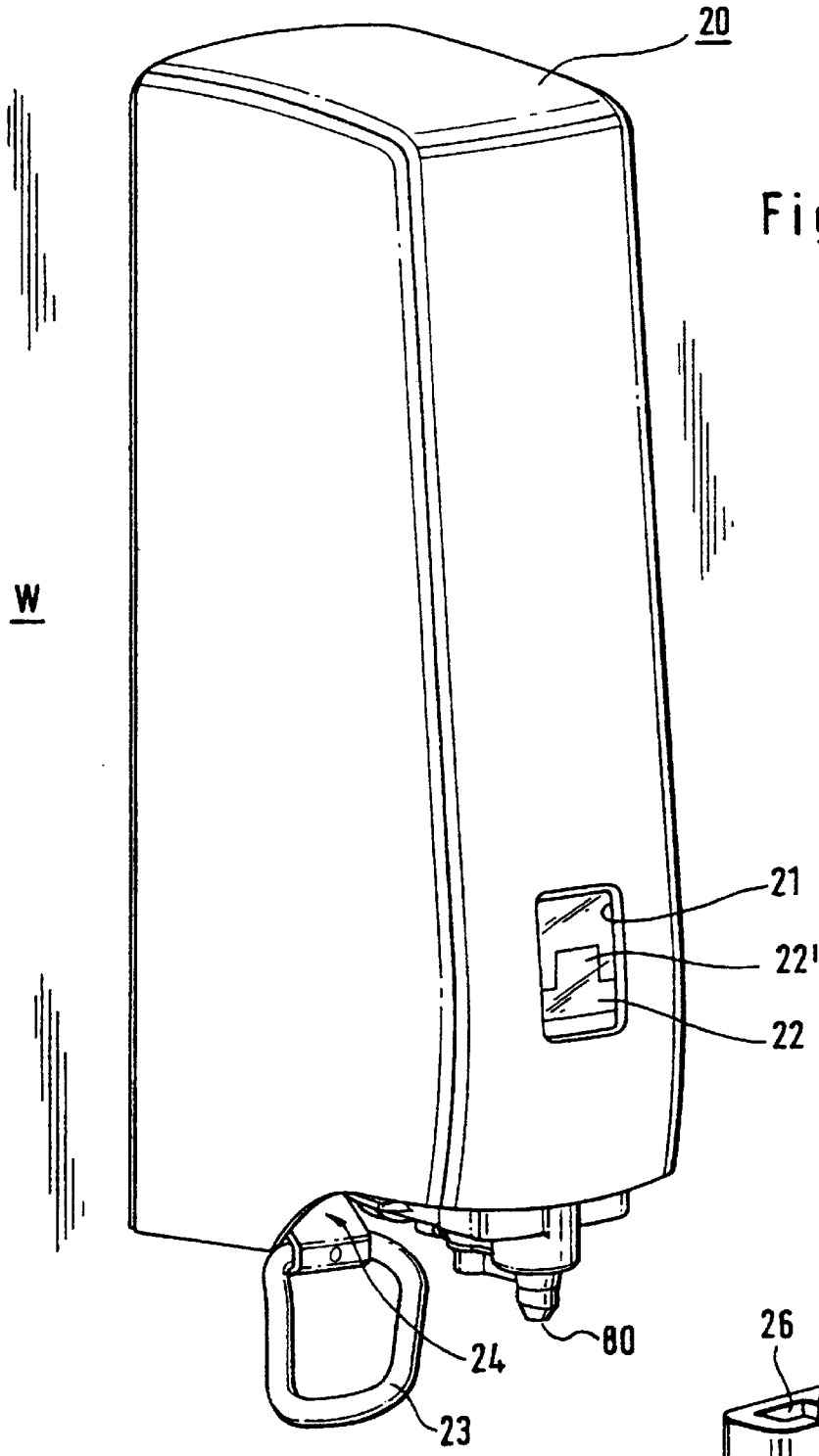
Fig. 2
Fig. 2a
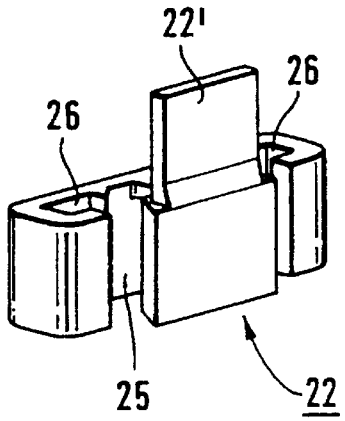

METHOD AND DEVICE FOR THE CONTROLLED DISPENSING OF CLEANSING FOAM

The invention relates to a method of dispensing foam and to an apparatus according to the preamble of claim 1 and claim 4, respectively.

Foam dispensers of that kind are frequently used in washrooms and toilets, especially of public facilities, restaurants, etc. They are also found in areas having high hygiene requirements, such as the food industry, healthcare etc., where they are often operated with soap solutions that contain disinfectants.

Figure 4:
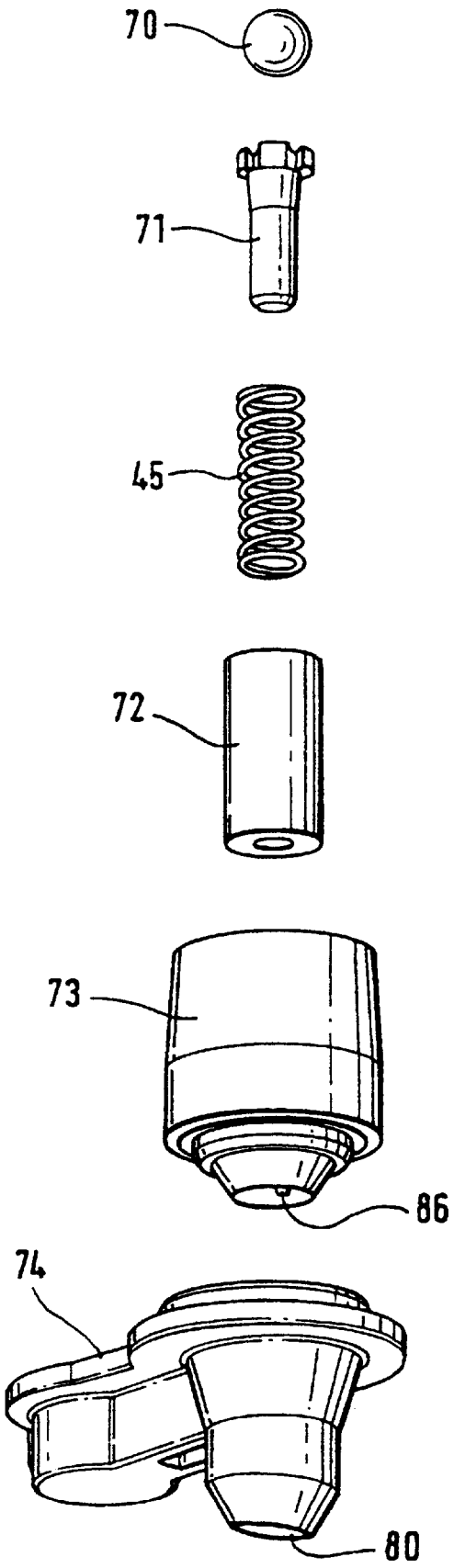

WO 90/14037, FIG. 4, discloses a concentrically constructed foam dispenser that sucks in air from the dispenser housing via a non-return valve, compresses it and, at the same, feeds soap solution out of an intermediate vessel. The two media are combined in a mixing chamber; the coarse-bubbled foam formed therein is subsequently homogenised by means of a foamer and expelled for hand washing.

The known apparatus is relatively bulky and consists of numerous individual parts which in time become soiled and clog and/or contaminate the dispenser. In addition, it has a tendency to drip since, in the mixing chamber and in the dispenser, the residual foam collapses to some extent and, especially during prolonged breaks in operation, agglutinates to some extent.

The object of the invention is therefore to provide a method for controlled foam production and delivery and to construct a foam dispenser that does not have the disadvantages of the prior art and, in particular, does not have a tendency to drip.

The dispenser to be provided is to be reliable in operation and provide improved hygiene conditions. It is intended to have a large intermediate vessel with an easily visible filling level indicator so that sufficient time is available in every case to replace the empty supply bottle with a new, filled supply bottle. In addition, the dispenser is to be economic to manufacture and is to require a minimum of maintenance.

According to the invention, the object is achieved by the features of claim 1.

According to the method, in the first phase, after the formation and dispensing of the foam, the dispensing nozzle is blown clear; in the second phase, a slight negative pressure is produced there, which destroys the remaining foam.

The liquid lamellae forming the foam undergo expansion as a result of the back-suction (negative pressure) and, owing to their thermodynamic instability, are broken up at the inner surface of a nozzle/expansion body, that is to say, a minimum amount of soap solution is produced there which, with the next positive stroke of the piston, is foamed again and expelled (with the foam portion).

As a result of that measure, the nozzle space always remains clean; it does not become encrusted and therefore the dispenser is capable of operating even after long breaks in operation.

Developments of the subject-matter of the invention are characterised in dependent claims.

The method according to claim 2 can be integrated very easily into existing constructions of air cylinders.

The development according to claim 3 is a solution that is especially interesting from an economic viewpoint.

Residual foam present in the foam delivery bore is successfully destroyed by an expansion upstream, with the result that no dripping occurs.

The apparatus according to claim 5 has the advantage of a very hygienic and operationally reliable construction.

Passing over a single air passage, which is mentioned in claim 6, is especially efficient and replaces the valves, air directing means, air guides, stepped piston rods for temporary air supply etc. which are required in other conceivable constructions.

The embodiment according to claim 7 is especially effective.

The construction according to claim 8 prevents the ingress of germs etc. into the dispenser and ensures a decisive improvement in hygiene conditions.

The embodiment according to claim 9 serves to prevent the supply vessels from being confused with one another; it increases operating reliability and serves to ensure that suitable soap solutions are used, especially in critical areas (food production and distribution, healthcare etc.).

Illustrative embodiments of the invention are described below using as an example a dispenser supplied with soap solution.

Figure 1:
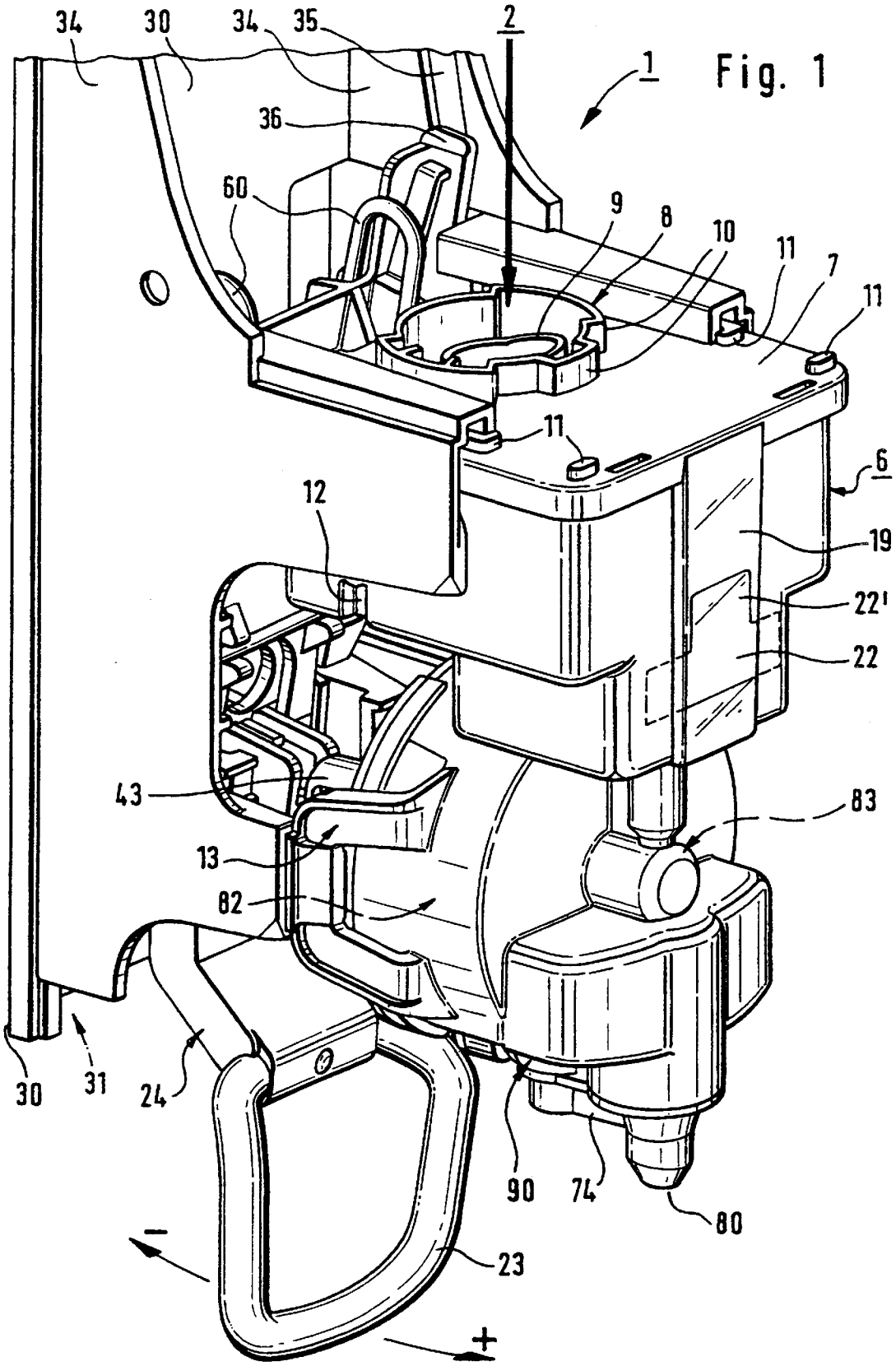
Figure 3:
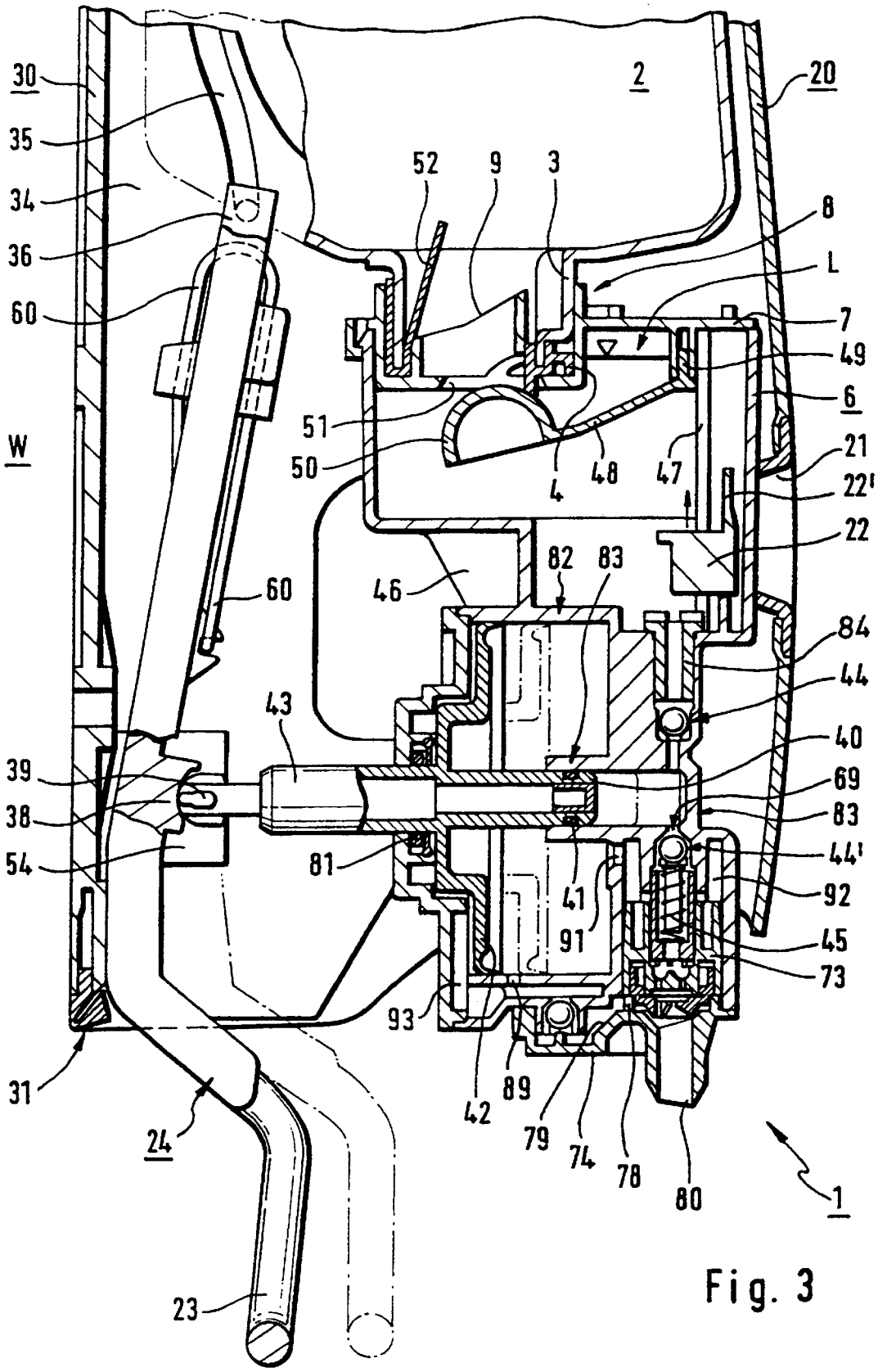
Figure 5:
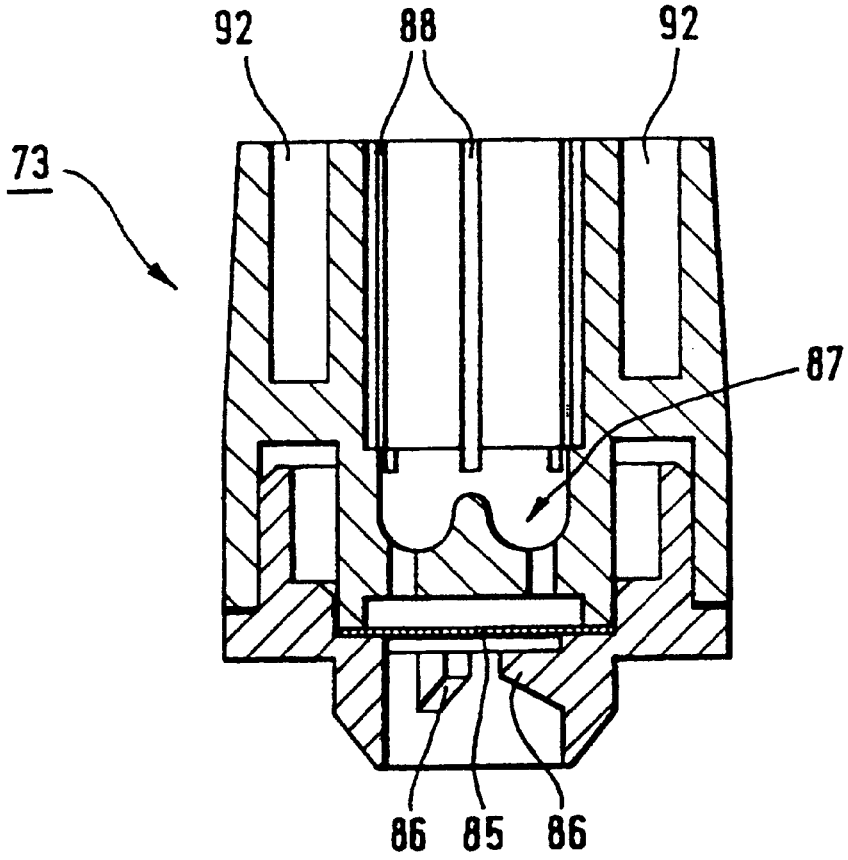
Figure 6:
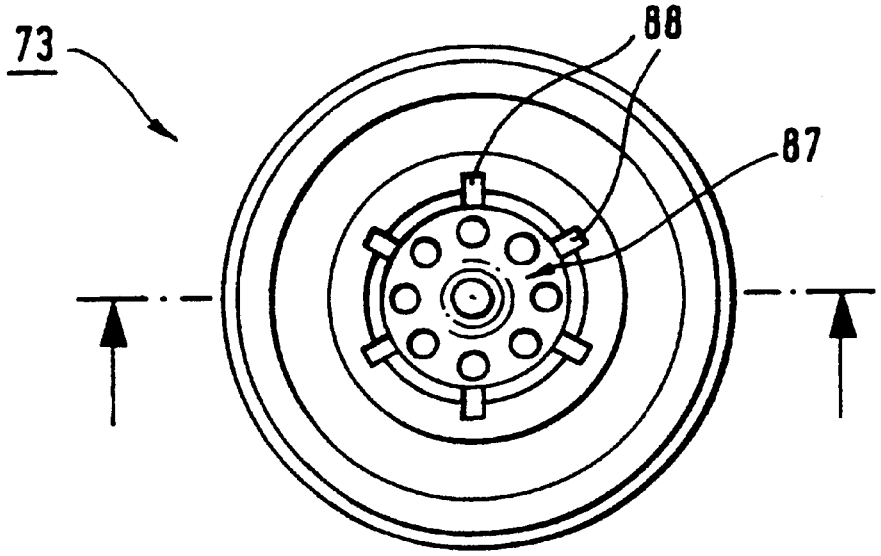
Figure 7A:
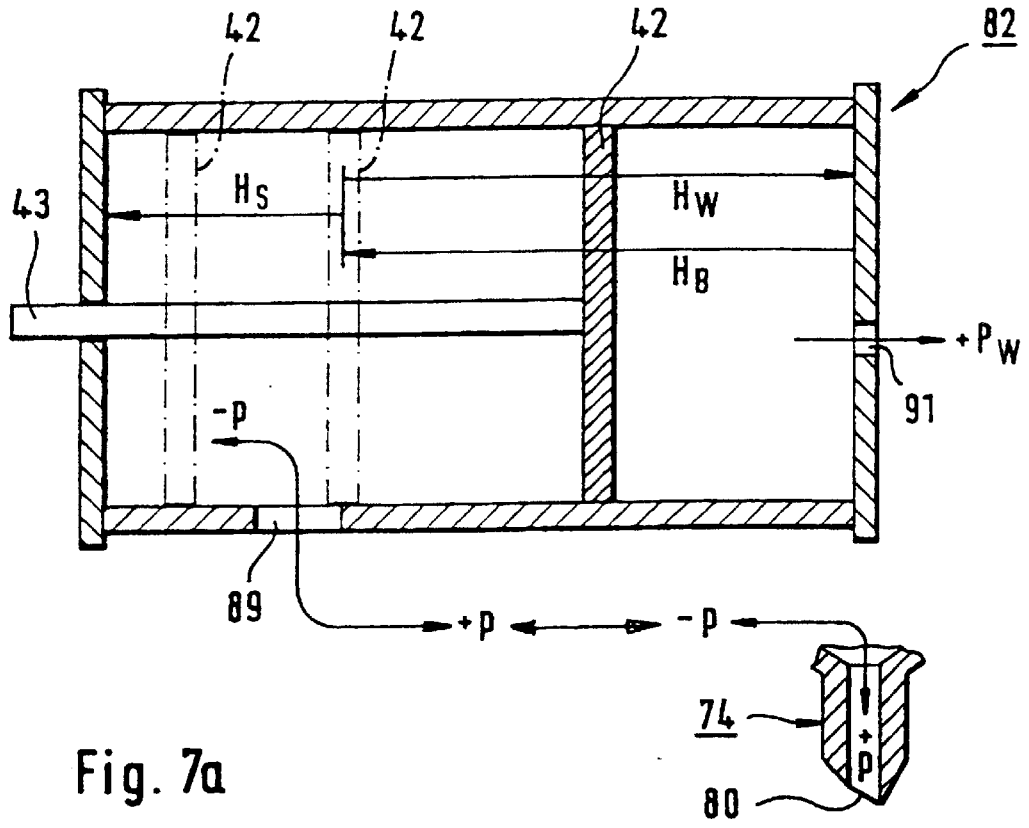
Figure 7B:
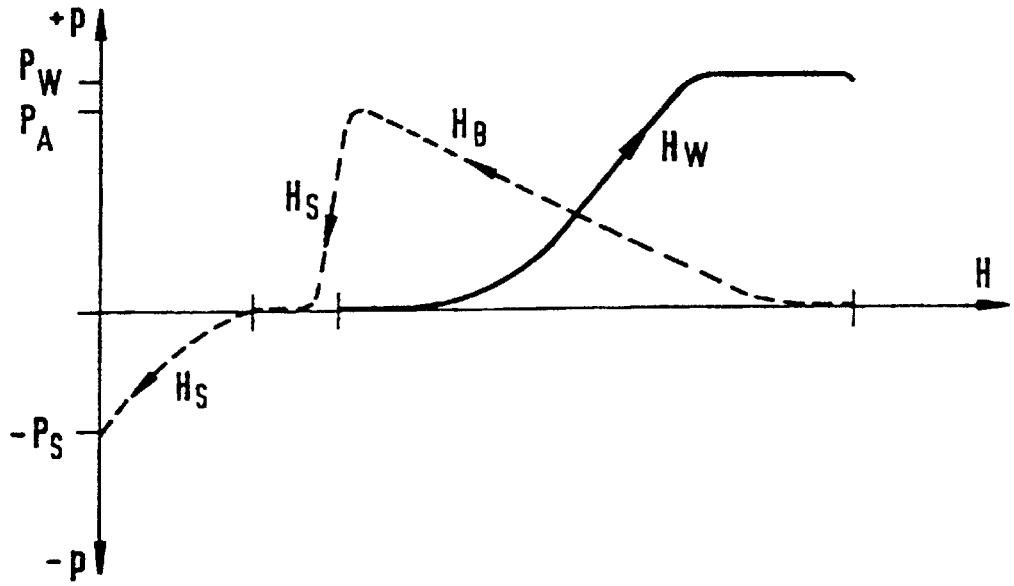
Figure 7C:
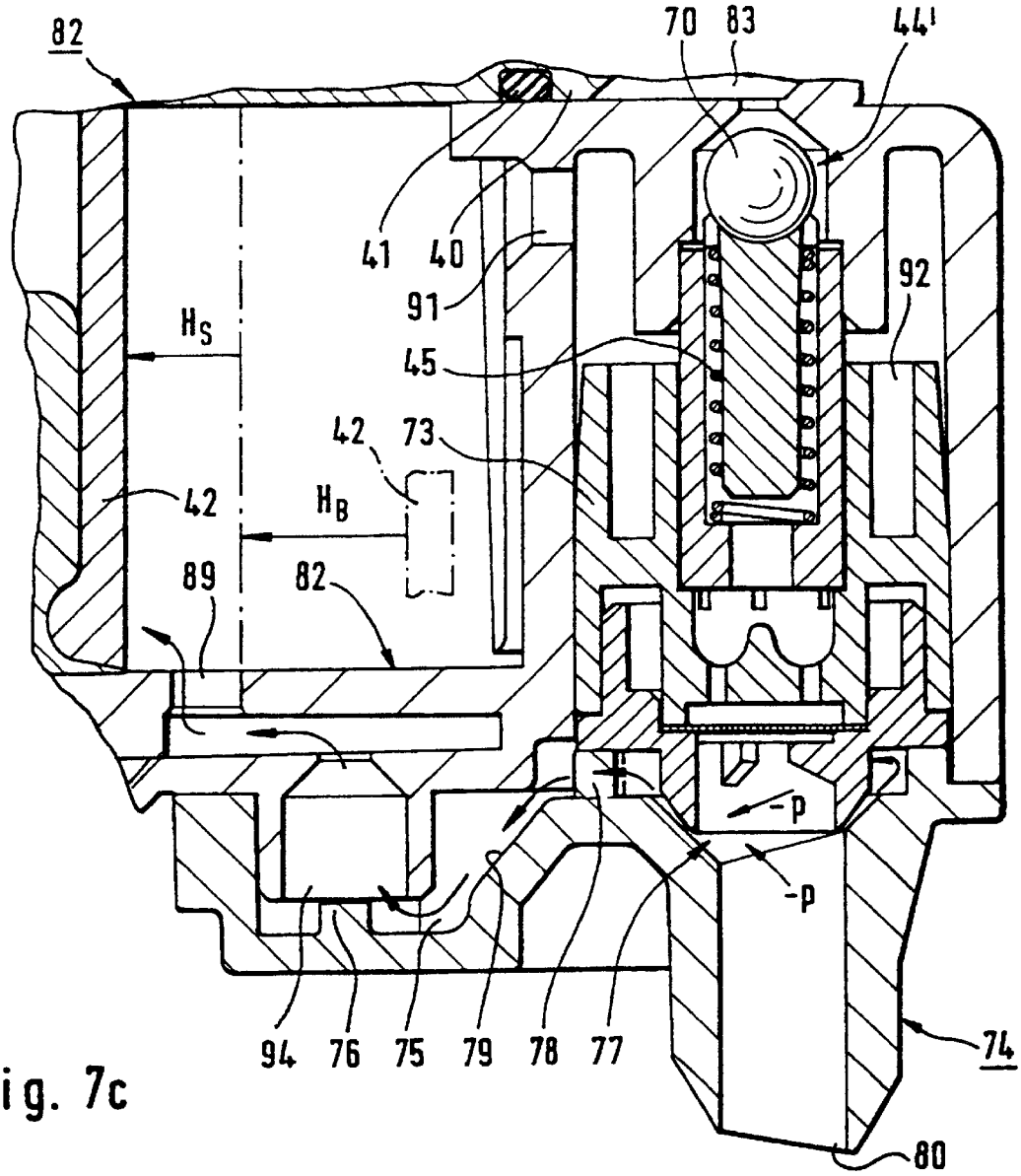
Figure 8:
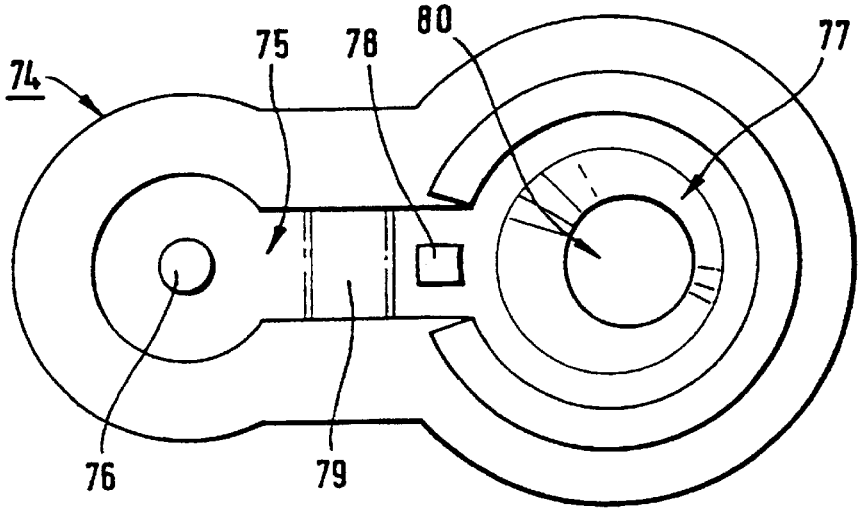

In the drawings:

FIG. 1 is a partial view of a foam dispenser shown in perspective,

FIG. 2 shows the dispenser of FIG. 1 ready for operation, mounted on a wall, FIG. 2*a* shows the float of a filling level indicator, which float can be seen in FIG. 2, FIG. 3 shows the dispenser according to FIG. 1 in section, FIG. 4 shows a foamer according to FIG. 3 in a so-called exploded view with its associated nozzle/expansion body, FIG. 5 shows a vertical section through the foamer according to FIG. 4, FIG. 6 is a central plan view of the foamer according to FIG. 5, FIG. 7*a* is an elementary diagram of an air cylinder with an air piston in three characteristic stroke positions, FIG. 7*b* shows the typical pressure curve at a radial air passage of the air cylinder of FIG. 7*a*, FIG. 7*c* shows a section through a lower half of an air cylinder with an attached nozzle/expansion body, and FIG. 8 shows the nozzle/expansion body in plan view from above.

In FIG. 1, reference numeral 1 denotes a foam dispenser, shown in part, which is supplied with soap solution by an overhead supply vessel. The supply bottle 2, symbolised by an arrow, is inserted into an adapter 8 having a central piercing sleeve 9 and a keying edge 10 which are let into a closure lid 7 of an intermediate vessel 6 formed in the manner of a bird's drinking vessel. Also disposed on the lid 7 are clamping and locking elements 11 which fit corresponding sectional members in side cheeks 34 on a rear wall 30 and permit simple mounting and dismounting of the functionally essential parts of the dispenser 1.

At the front, a vertical, projecting, transparent part 19 can be seen on the intermediate vessel 6, in which a float 22 with a lug 22' forming a filling level indicator is disposed. Arranged below the latter are a soap-metering cylinder 83 and an air cylinder 82, the latter being supplied by a air inlet valve 90 not shown. A delivery bore 80 for soap foam and a nozzle/expansion body 74 can also be seen.

Curved grooves 35 are let into the side cheeks 34, which grooves 35 are engaged by pins, projecting on both sides from flanges 36, of a lever 24 which is provided with an operating ring 23 at its lower end. The operating lever 24 is urged into the position shown by double-bend spring wires 60 which lie opposite each other.

The direction of movement of the ring 23 is denoted by + and −, the + direction corresponding to the forward stroke (working stroke) and the negative direction (–) corresponding to the backward stroke of the piston rod designated 43.

The air cylinder 82 is provided with a pump support 13 which is snapped into position on the side cheeks 34; lateral guides 12 which serve for exact positioning are also let into the intermediate vessel 6.

There is also disposed below the side cheek 34 a joint 31, a film hinge, which serves to join the rear wall 30 to a fold-down hood 20, see FIG. 2.

In the following Figures, parts having identical functions are provided with identical reference numerals.

The view according to FIG. 2 shows the external shape of the hood 20 and hence of the entire housing of the apparatus, an observation window 21 for the filling level indicator having been cut out at the front.

The float 22 is shown in its entirety in FIG. 2*a*. The lug 22' projects from a float body 25, while sectional guide members 26 having grooves are arranged on both sides of the body 25.

Further details of the dispenser shown in FIGS. 1 and 2 can be seen from the view in section given in FIG. 3. In that Figure, the lower part of the supply vessel 2 is shown in its entirety. A bottle neck 3 has a part 4 placed on it in a liquid-tight manner, which part 4 identifies and keys the bottle. In the interior of the bottle neck 3, a pierced diaphragm 52 can be seen, which serves as the bottle closure. Piercing is effected, upon insertion of the vessel 2, by the piercing sleeve 9 in the adapter 8 which is matched in shape to the keying part 4.

Upon insertion of the supply vessel 2, a projection provided on the bottle neck 3 is thrust onto a hemispherical closure plug 50, moves the latter away from the valve seat 51 and opens the passage for the soap solution, with the result that the level illustrated is obtained, which is kept constant by a topped-up air space L. The closure plug 50 is integrally provided, via a spring plate 48, with two mounting pins 49 lying opposite each other and is inserted in the closure lid 7.

It will also be seen that the float 22 slides upward along a guide ledge 47 as soon as there is soap solution in the intermediate vessel 6.

The soap solution is able to pass via a soap passage 69 and a passage pin 84 to a floating non-return valve 44 which is arranged at the top of the soap-metering cylinder 83. At the opposite end, there is a further non-return valve 44' which is pressed against its upper valve seat by a valve spring 45. Below that, a foamer 73 can be seen, which is terminated by a nozzle/expansion body 74 and is provided with an oblique-angled delivery bore 80.

In the air cylinder 82, an axially displaceable air piston 42 can be seen, which is formed integrally with the piston rod 43 and a soap solution piston 40 arranged at the front. Two bores can also be seen in the air cylinder 82, the radial bore being an air passage 89 to the nozzle/expansion body 74 and the axial bore being an air passage 91 to the foamer 73.

The rear end of the piston rod 43 is inserted between two lateral guides 54 and has a bearing pin 39 which is engaged laterally in a pressing cam 38. By means of that non-positive coupling, the piston rod 43 is guided horizontally by the operating lever 24 in the + and – direction (cf. FIG. 1); the forward end position of the lever 24 is indicated by a dot-dash line. Also to be seen is the spring 60 that is towards the front as viewed by the observer and which, in the manner of a plate spring, causes the lever 24 to be returned to its rear end position.

The individual parts of the foamer and the construction of the nozzle/expansion body 74 can be seen on a larger scale in FIG. 4. In addition to that which has been shown in FIG. 3, a valve ball 70, a plug 71 having a central passage, and a pipe piece 72 which serves to guide the spring 45 can be seen. In the lower portion of the foamer 73, but still arranged therein, a foam divider 86 can be seen.

Further individual parts of the foamer 73 can be seen from the enlarged views shown in FIG. 5 and FIG. 6. A pre-foaming chamber 87 formed as three-dimensional surface will be seen, which can be supplied with compressed air through the channels 88 which serve to guide the air; the metered soap solution is supplied, as shown in FIG. 3, from the top to an outer casing space 92.

The foaming principle is well known as such, as are the diaphragm screen 85 at the lower end of the foamer 73, which serves for refining and homogenisation, and the foam divider 86.

The plan view of the foamer 73 shows, in FIG. 6, well-known foam nozzles through which the compressed air forces the foam formed in the pre-foaming chamber 87 from above through the air guides 88.

The air cylinder 82 shown diagrammatically in FIG. 7*a* makes it possible to see its mode of operation:

A forward stroke $H_W$ which serves to foam the soap solution is effective from when the air piston 42 passes over the radial air passage 89; over the stroke path H, the pressure curve p shown in FIG. 7*b* is produced, up to a maximum value of the effective pressure $P_W$ That effective pressure $P_W$ is delivered to the attached foamer via the axial air passage 91.

On the backward stroke $H_B$, the pressure curve shown by a dashed line in FIG. 7*b* is produced, up to a maximum value $P_A$ which is reached before the air passage 89 is crossed. Thereafter, the pressure p falls and changes its sign after the piston 42 passes over the air passage 89. That part of the backward stroke is designated $H_S$ and assumes a relatively small maximum negative pressure $-P_S$.

It can thus be seen from the two Figures that the nozzle/expansion body 74 which is in communication with the air passage 89 is first blown out via the bore 80 and that, subsequently, a back-suction occurs.

A preferred construction of an air cylinder 82 with foamer 73 and nozzle/expansion body 74 is shown in half in FIG. 7*c*.

In contrast to the construction according to FIG. 3, in FIG. 7*c* only a single air passage 89 is provided.—In addition to a radial passage 89, the variant according to FIG. 3 has channels 93 that are also connected to the nozzle/expansion body 74.

In FIG. 7*c*, the single air passage 89 is constructed analogously to FIG. 7*a*; the backward stroke $H_B$ and the further backward stroke $H_S$ are also shown. In keeping with the end position of the air piston 42, the back-suction direction characterised by arrows is designated –p.

The physical effect of the back-suction can be seen by reference to the nozzle/expansion body 74 according to FIG. 7*c* and FIG. 8.

As soon as a negative pressure occurs in the air cylinder 82, the soap foam that remains in the slot-shaped space formed between the lower end of the foamer 73 and the nozzle/expansion body 74 is sucked back through that space, meets the baffle projection 78 and, owing to the subsequent increase in surface area, condenses in the form of small soap droplets on a drainage surface 79 and drains into the annular valve/drop chamber 75.

When a subsequent positive stroke occurs, the air stream passes through the air passage 89, via the upper expansion chamber 94, onto the impact head 76, and produces foam in the drop chamber 75 once more; because of the longer distance and the lower pressure, this is then expelled through the bore 80 approximately simultaneously with the foam generated by the working stroke $H_W$.

The filling of the air cylinder which is necessary for the working stroke $H_W$ is effected to a very great extent via the air inlet valve 90 indicated in FIG. 1, since the latter offers significantly lower flow resistance than the labyrinthine configuration of the by-pass at and in the nozzle/expansion body 74. The same applies also upon delivery of the foam; no premature sucking-back of the metered foam is perceptible.

The subject-matter according to the invention represents a considerable improvement in terms of its reliability, cleanliness and hygiene in comparison with the prior art mentioned at the beginning.

By virtue of the freely selectable and more constant stroke rates which are obtained in electromechanically driven dispensers, the subject-matter of the invention can be further optimised and in that case exhibits additional action during back-suction.

What is claimed is:

1. A method for the controlled portion-wise delivery of foam in a device for producing and metering foam that is prepared from a foamable liquid by supplying compressed air to produce a coarse-bubbled foam which is refined and homogenised in a downstream foamer, wherein, in a compressed air cylinder, a forward stroke of an air piston is used for foam production and a backward stroke is used for blowing the foam out of a foam delivery bore, characterized in that an air flow produced by the backward stroke of the air piston is introduced into a region of the foam delivery bore as an excess pressure in a first phase and as a negative pressure in a second phase, the foam present in the delivery bore being substantially blown out in the first phase and a residual foam portion which remains expanding under negative pressure and collapsing in the second phase.

2. A method according to claim 1, characterised in that the reversal of the direction of pressure flow is produced by a radial air passage which, in the first phase, is in front of the air piston which is being moved on the backward stroke and, in the second phase, is behind the air piston which is on the backward stroke.

3. A method according to claim 2, characterised in that the reversal of the direction of pressure flow is produced by a single air passage that is arranged radially in the compressed air cylinder and that is stationary in the region of the backward stroke.

4. A method according to claim 1, 2 or 3, characterized in that, behind the foam delivery bore, the pressure flow of the backward stroke is expanded.

5. An apparatus for carrying out the method according to claim 1 in a device for the production and controlled portion-wise delivery of foam, comprising an overhead supply vessel for a soap solution, an intermediate vessel having a filling level indicator, a metering device for soap solution and a compressed air cylinder having a double-action air piston, the compressed air produced on the forward stroke leaving at a front of the cylinder, a mixing chamber for air and soap solution and a foamer having a downstream delivery bore for metered soap foam, characterized in that there is provided in the compressed air cylinder at least one radial air passage pneumatically connected to the foam delivery bore.

6. An apparatus according to claim 5, characterized in that a single air passage is present over which the air piston slides during the backward stroke.

7. An apparatus according to claim 5 or 6, characterized in that a nozzle/expansion body is connected between the air passage and an outlet of the foamer.

8. An apparatus according to claim 6, characterized in that the intermediate vessel is covered at a top by a closure lid in which a resiliently arranged closure plug is mounted in such a manner that the intermediate vessel is always closed when the supply vessel is not inserted into the intermediate vessel.

9. An apparatus according to claim 8, characterized in that an adapter is provided on the closure lid, which adapter has a keying edge that corresponds to keying parts arranged on the neck of the supply vessel.

10. An apparatus according to claim 6 or claim 8, characterized in that guide elements are provided in the intermediate vessel, which guide elements guide a vertically movable float with an indicating lug in a projecting vertical portion.

11. An apparatus according to claim 6, 8 or 9, characterized in that a piercing sleeve is provided in the closure lid, for piercing a diaphragm in the supply bottle as the supply bottle is being placed on the closure lid.

12. The use of the apparatus according to claim 6 or claim 8 or claim 9 in a manually or electromechanically operated foam dispenser for delivering soap foam for hand washing.

* * * * *